US007616098B2

(12) United States Patent
Al-Sabah

(10) Patent No.: US 7,616,098 B2
(45) Date of Patent: Nov. 10, 2009

(54) ELECTRONIC PERSONAL ASSISTANT DEVICE FOR SOCCER GAME OFFICIAL

(76) Inventor: Sabah Naser Al-Sabah, P.O. Box 7000, Kuwait City (KW)

( * ) Notice: Subject to any disclaimer, the term of this patent is extended or adjusted under 35 U.S.C. 154(b) by 413 days.

(21) Appl. No.: 11/428,604

(22) Filed: Jul. 5, 2006

(65) Prior Publication Data

US 2007/0010335 A1 Jan. 11, 2007

Related U.S. Application Data

(60) Provisional application No. 60/696,712, filed on Jul. 5, 2005.

(51) Int. Cl.
*G07C 1/22* (2006.01)

(52) U.S. Cl. ..... 340/323 R; 463/42; 463/46

(58) Field of Classification Search ..... 463/42, 463/46; 340/323 R

See application file for complete search history.

(56) References Cited

U.S. PATENT DOCUMENTS

| | | | | |
|---|---|---|---|---|
| 5,592,361 | A * | 1/1997 | Smith et al. | 361/679 |
| 5,745,029 | A * | 4/1998 | Garcia | 340/323 R |
| 6,122,559 | A * | 9/2000 | Bohn | 700/91 |
| 6,443,341 | B1 * | 9/2002 | Rittmann | 224/219 |
| 7,041,032 | B1 * | 5/2006 | Calvano | 482/4 |
| 2005/0162257 | A1 * | 7/2005 | Gonzalez | 340/323 R |

FOREIGN PATENT DOCUMENTS

| | | | |
|---|---|---|---|
| DE | 197 18 887 | | 11/1998 |
| DE | 100 01 296 | | 7/2000 |
| DE | 10001296 | A1 * | 7/2000 |
| WO | 02/087707 | | 11/2002 |
| WO | WO 02087707 | A1 * | 11/2002 |
| WO | 2004/073809 | | 9/2004 |
| WO | WO 2004073809 | A1 * | 9/2004 |

OTHER PUBLICATIONS

European search report mailed Sep. 10, 2007 from the European Patent Office to Botti & Ferrari S.r.l.

* cited by examiner

*Primary Examiner*—James S McClellan
(74) *Attorney, Agent, or Firm*—Allen Dyer Doppelt Milbrath & Gilchrist

(57) ABSTRACT

A soccer electronic personal assistant device includes a housing having a connector for securing the housing to a game official's wrist or arm. A penalty card pocket is disposed on the housing and containing one or more player penalty cards. A microprocessor is contained in the housing and programmed to process game associated information. Sufficient memory storage is associated with the microprocessor for storing game associated information. A display screen is positioned in the housing operably connected to the microprocessor to visually display game associated information for the official. A keypad input device having a plurality of keys operably connected with the microprocessor for official to enter or retrieve game associated information. A sound output device is operably connected to the microprocessor to receive a signal therefrom and to generate sound responsive thereto and a transceiver disposed in the housing and capable of wirelessly transmitting and receiving game associated information.

19 Claims, 2 Drawing Sheets

ELECTRONIC PERSONAL ASSISTANT DEVICE FOR SOCCER GAME OFFICIAL

RELATED APPLICATION

This application claims priority from provisional application Ser. No. 60/696,712 which was filed on Jul. 5, 2005, and which is incorporated herein by reference in its entirety.

FIELD OF THE INVENTION

The present invention relates to the field of sports and, more particularly, to an electronic personal assistant device tailored for use by a soccer game official.

BACKGROUND OF THE INVENTION

The field game of soccer, which is known as "football" in every country but the U.S., is the most popular game in the world. Soccer is played not only in developed countries but also in developing countries in every continent. Children begin playing soccer when quite young, using whatever round objects may be available as substitutes for a regulation ball, and using streets and empty lots as game fields. The game promotes exercise, coordination and friendly competition among children and older players alike. Additionally, local, regional and even international competition offer rewards, recognition and avenues to a better life to those skilled enough to be able to make professional and semi-professional teams. Players may additionally develop into trainers and coaches and, thus, may be able to extend their playing career into a lifetime of work in association with the sport.

Even with its worldwide popularity and appeal, the soccer game official continues to officiate the game with the same tools that were in use early in the twentieth century. Game officials continue to use writing pads and pencils to keep track of game associated information. Officials continue to carry penalty cards in their pockets, ready to pull out for use when a player commits an infraction. Officials continue to rely on the mouth-blown whistle. Officials use signals to communicate with each other and to transmit information to the audience and to official timekeepers and others on the sidelines. Officials carry no specific information on the opposing teams or the individual players, other than whatever is in the official's memory or written on his notepad.

SUMMARY OF THE INVENTION

With the foregoing in mind, the present invention advantageously provides an electronic personal assistant device (EPAD) useful to a soccer game official in keeping track of game associated information. The EPAD is preferably worn by the official fastened on his wrist or arm and provides all the functions the official requires to run the game.

The soccer electronic personal assistant device (EPAD) includes first a housing having a connector for securing the housing to a game official's wrist or arm. A preferred connector would be one or more straps that would secure the EPAD to the official's arm, as shown in FIG. 1. The device includes a penalty card pocket, or holder, disposed on the housing and containing one or more player penalty cards, for example, the well known yellow card and red cards. A microprocessor is contained in the housing and is programmed to process game associated information. Memory storage is associated with the microprocessor for storing game associated information and may include expansion memory by way of a connector slot which receives a memory expansion card or module. A display screen is positioned in the housing operably connected to the microprocessor to visually display game associated information for the official. A keypad input device having a plurality of keys operably is connected with the microprocessor for the official to enter or retrieve game associated information. A sound output device is operably connected to the microprocessor to receive a signal therefrom and to generate sound responsive thereto. The sound output device may reproduce the sound of a mouth blown game whistle and may generate such sound automatically according to a time keeping function of the microprocessor. A transceiver is disposed in the housing and is capable of wirelessly transmitting and receiving game associated information. The transceiver allows various EPAD units carried by the several officials to communicate with each other.

The present EPAD system may also be expanded to include the audience. For example, audience members may rent or purchase an audience EPAD, which lacks some of the functionalities of the game official EPAD but which may receive communications directly from game officials on the field, so that the audience member feels even more like a participant in the event. As soon as a game official enters information into his EPAD, the information is also available for display on the screens of the audience EPADs. Audience members may also use their audience EPADs to recall stored game associated information, for example, how many penalties may have been charged to a particular player, how much time remains in the game, how much stoppage time will be added to the clock after regulation time runs out, etc. The audience EPADs may be rented at the stadium or may be purchased by fans, thereby creating additional income for the sport. Audience EPADs may be adorned with colors and/or indicia specific to a particular team which the fan supports.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 1:
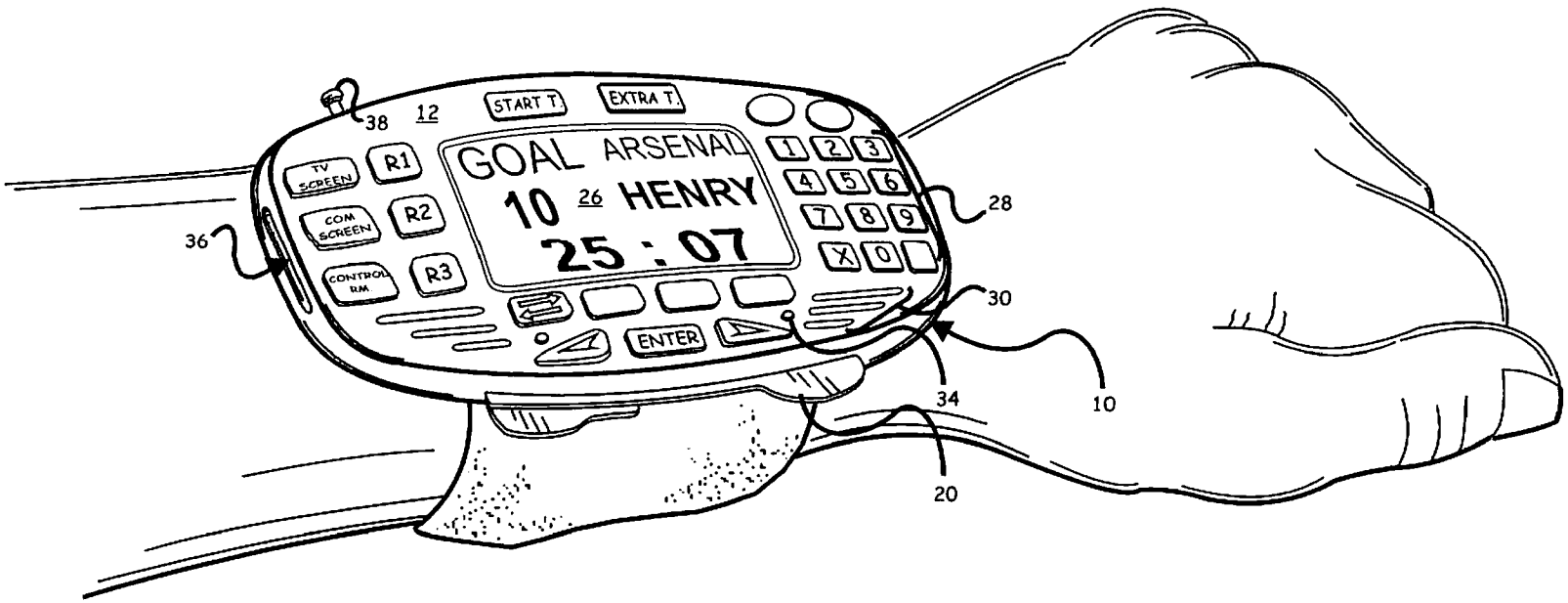
FIG. 1 illustrates an electronic personal assistant device for a game official, according to an embodiment of the present invention.
Figure 2:
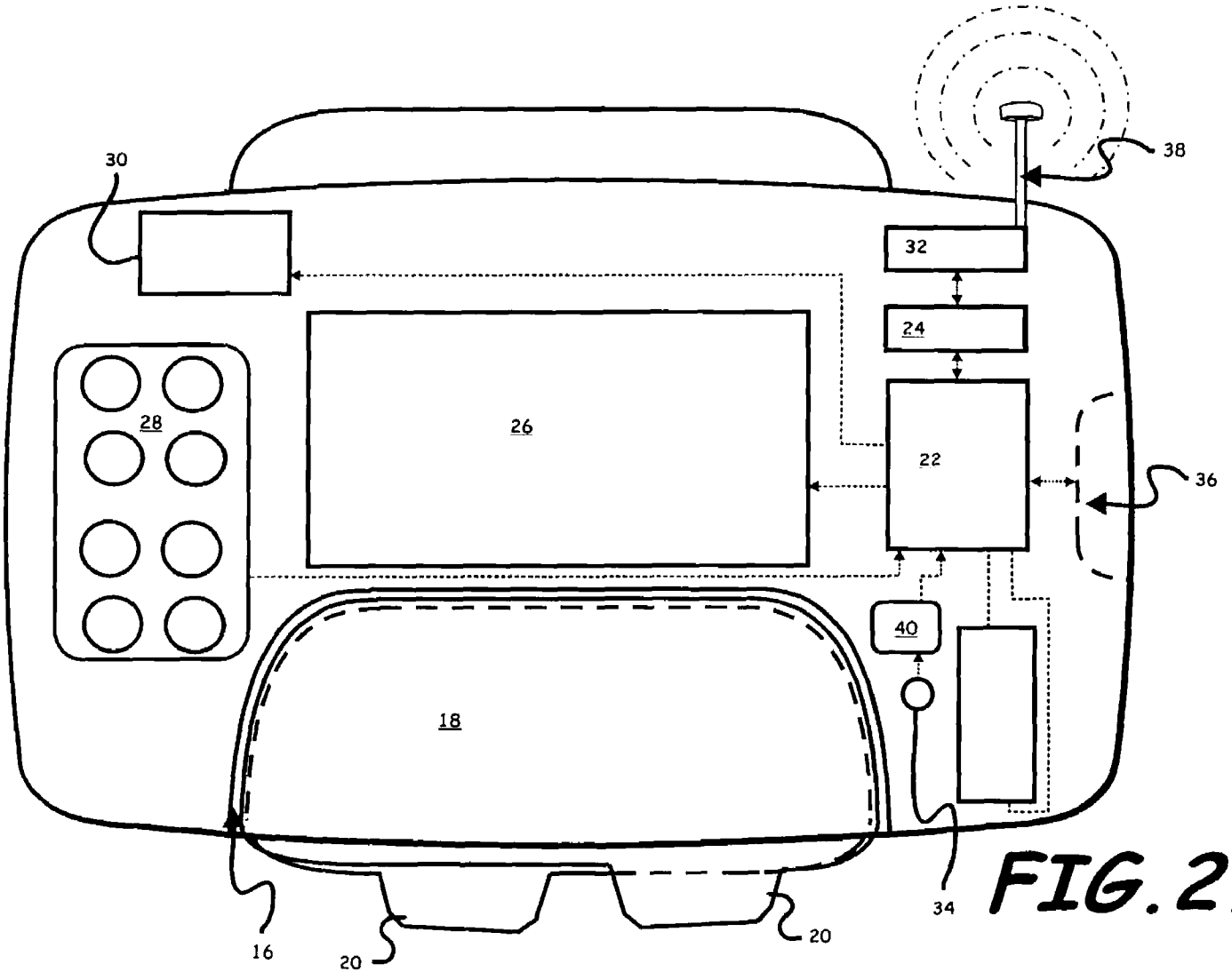
FIG. 2 shows a schematic diagram of the hardware components of the EPAD of FIG. 1.

FIGS. 1 and 2 illustrate a soccer electronic personal assistant device 10 (EPAD) according to the present invention. The EPAD 10 includes a housing 12 having a connector 14 for securing the housing to a game official's wrist or arm. The connector 14 is preferably some type of strap device as known in the art and may include hook and loop closures, such as Velcro®. A penalty card pocket 16 or holder is disposed on the housing 12, preferably along one side periphery of the housing, and contains one or more player penalty cards 18. The penalty cards 18 may include a tab 20 which protrudes from an edge of the card, as shown in FIG. 1, and which provides a grab point for pulling the card out of the pocket 16. A microprocessor 22 is contained in the housing 12 and is programmed to process game associated information. Memory storage 24 is associated with the microprocessor 22 for storing game associated information. A display 26 is positioned in the housing 12 operably connected to the microprocessor 22 to visually display game associated information for the official. The display 26 is best positioned along an upper periphery of the housing 12, such as shown in FIG. 1, so that it will be easily visible to the game official carrying the EPAD. A keypad input device 28, preferably a keypad having a plurality of keys, is operably connected with the microprocessor 22 for the official to enter or retrieve game associated information. A sound output device 30 is operably connected to the microprocessor 22 to receive a signal therefrom and generate sound responsive thereto. The game official EPAD 10 also includes a transceiver 32 disposed in the housing 12 and capable of wirelessly transmitting and receiving game associated information.

Optional features of the game official EPAD 10 include an embodiment of the device comprising at least one microphone 34 connected to accept game associated information input by voice. As noted above, the EPAD 10 may also include an expansion slot 36 operably connected with the microprocessor 22 and capable of accepting a memory expansion card or module (not shown). The sound output device 30 may preferably include the capability of sounding a game whistle, substituting for the traditional mouth-blown whistle used by game officials. The EPAD 10 may preferably further include an antenna 38 coupled to the transceiver 32 to thereby receive and transmit wireless signals. The soccer EPAD 10 may also provide a stop watch function, preferably resident in the microprocessor 22 and controlled by one or more of the plurality of keys. The stopwatch function may be able to simultaneously track multiple game associated times responsive to one or more keys on the keypad 28.

Additionally, the soccer EPAD 10 may further comprise a sound input device or microphone 34 and a voice chip 40 associated with the microprocessor 22, the voice chip being capable of converting a voice signal received in the sound input device to a digital signal which may then be stored in the device as game associated information.

Another embodiment of the present invention includes a system of soccer electronic personal assistant devices (EPADs) 10 which includes a plurality of EPADs, each individual EPAD including a housing 12 having a connector 14 for securing the EPAD to an official's wrist or arm, a card holder 16 for one or more player penalty cards, a microprocessor 22 programmed to process game associated information, memory storage 24 associated with the microprocessor, a display 26 operably connected to visually display game associated information for the official, a keypad 28 enabling the official to enter or retrieve game associated information, at least one sound generator 30 and a transceiver 32 capable of wirelessly bidirectionally communicating game associated information among the plurality of EPADs. In this embodiment of the invention, each individual EPAD 10 of the plurality of EPADs is carried by one game official and contains an electronic signature identifying the official carrying the EPAD. Optional features of each game official EPAD in this additional embodiment are as described above with reference to the first embodiment of the device.

In yet another embodiment of the present invention, a system of soccer electronic personal assistant devices (EPADs) includes a plurality of electronic personal assistant devices (EPADs) for game officials, a central computer and one or more audience display screens. Each individual game official EPAD includes all the features and functionalities described above and also includes an individual electronic signature identifying the official carrying the EPAD. A central computer has an associated transceiver capable of wireless communication with the plurality of EPADs, the central computer having memory storage for game associated information and updating the game associated information by wireless communication with the plurality of EPADs. Additionally, the system includes one or more audience display screens capable of displaying game related information for the audience responsive to a wireless signal from the central computer or from any one individual EPAD of the plurality of EPADs.

In yet a further embodiment of the present invention, a system of soccer electronic personal assistant devices (EPADs) includes a plurality of game official EPADs 10 and a plurality of audience member EPADs (not shown). Each individual game official EPAD 10 includes the structures and functionalities described above, including an electronic signature identifying the official carrying the EPAD. Each audience member EPAD includes a housing 12, a microprocessor 22 programmed to process game associated information, memory storage 24 associated with the microprocessor for storing game associate information, a radio frequency receiver (not shown) capable of wirelessly receiving game associated information from the plurality of game official EPADs, a keypad 28 enabling the individual audience member to retrieve stored game associated information and a display 26 operably connected to visually display game associated information. The audience member EPAD is, essentially, limited to passively receiving and displaying game associated information, whereas the game official EPAD is interactive and may be used to enter game associated information into the system, as well as recall stored game associated information for display. Availability of audience member EPADs creates the opportunity for generating additional income for the sport, by selling or renting the units to the audience. Furthermore, audience EPADs could be marketed in specific team colors or bearing team logos, to increase visibility and fan support for teams.

In yet a further variation of the present invention, the game official EPAD 10 wireless signals could be also carried by satellite or cable television services, so that fans at home or watching the game at sports bars and the like could wear their own audience EPAD and receive game associated information in real time, and thereby could feel a greater degree of participation in the game.

Accordingly, in the drawings and specification there have been disclosed typical preferred embodiments of the invention and, although specific terms are employed, the terms are used in a descriptive sense only and not for purposes of limitation. It should be understood that the individual components of the invention are as known by those skilled in the art. It will be apparent, however, that various modifications and changes can be made within the spirit and scope of the invention as described in the foregoing specification and as recited in the appended claims.

That which is claimed:

1. A soccer electronic personal assistant device (EPAD), said device comprising:

a housing having a connector for securing said housing to a game official's wrist or arm;

a penalty card pocket disposed on said housing and containing one or more player penalty cards;

a microprocessor contained in said housing and programmed to process game associated information;

memory storage associated with said microprocessor for storing game associated information;

a display screen positioned in said housing operable connected to said microprocessor to visually display game associated information for the official;

a keypad input device having a plurality of keys operably connected with said microprocessor for official to enter or retrieve game associated information;

a sound output device operable connected to said microprocessor to receive a signal therefrom and to generate sound responsive thereto; and a transceiver disposed in said housing and capable of wirelessly transmitting and receiving game associated information.

2. The soccer EPAD of claim 1, further comprising at least one microphone connected to accept game associated information input by voice.

3. The soccer EPAD of claim 1 further comprising an expansion slot operably connected with said microprocessor and capable of accepting a memory expansion card.

4. The soccer EPAD of claim 1, wherein said sound generator includes a referee game whistle.

5. The soccer EPAD of claim 1, further comprising an antenna coupled to said transceiver to thereby receive and transmit wireless signals.

6. The soccer EPAD of claim 1, further including a stop watch function resident in said microprocessor and controlled by one or more of said plurality of keys.

7. The soccer EPAD of claim 1, wherein said microprocessor comprises a stopwatch function able to simultaneously track multiple game associated times responsive to one or more keys on said keypad.

8. The soccer EPAD of claim 1, further comprising a sound input device and voice chip associated with said microprocessor, said voice chip capable of converting a voice signal received in said sound input device to a digital signal.

9. A system of soccer electronic personal assistant devices (EPAD)s, said system comprising:

a plurality of EPADs, each individual EPAD including a housing having a connector for securing the EPAD to an officials wrist or arm, a card pocket with one or more player penalty cards located therein, a microprocessor programmed to process game associated information, memory storage associated with said microprocessor, a display screen operable connected to visually display game associated information for the official, a keypad enabling the official to enter or retrieve game associated information, at least one sound generator and a transceiver capable of wirelessly bidirectionally communicating game associated information among the plurality of EPADs; and wherein each individual EPAD of the plurality of EPADs is carried by one game official and contains an electronic signature identifying the official carrying the EPAD.

10. The system of claim 9, wherein each individual EPAD further comprises at least one microphone connected to accept game associated information input by voice.

11. The system of claim 9, wherein each individual EPAD further comprises an expansion slot operably connected with said microprocessor and capable of accepting a memory expansion card.

12. The system of claim 9, wherein each individual EPAD contains a sound generator which includes a referee game whistle.

13. The system of claim 9, wherein each individual EPAD further comprises an antenna coupled to said transceiver to thereby receive and transmit wireless signals.

14. A system of soccer electronic personal assistant devices (EPADs), said system comprising:

a plurality of electronic personal assistant devices (EPADs) for game officials, each individual EPAD including a housing having a connector for securing the EPAD to an official's wrist or arm, a card pocket with one or more player penalty cards located therein, a microprocessor programmed to process game associated information, memory storage associated with said microprocessor, a display screen operably connected to visually display game associated information, a keypad enabling the game official to enter or retrieve game associated information, one or more sound generators and a transceiver capable of wirelessly communicating game associated information among the plurality of EPADs, wherein each individual EPAD of the plurality of EPADs is carried by one game official and has an individual electronic signature identifying the official carrying the EPAD;

a central computer having an associated transceiver capable of wireless communication with said plurality of EPADs, said central computer having memory storage for game associated information an dupdating the game associated information by wireless communication with the plurality of EPADs; and one or more audience display screens capable of displaying game related information for the audience responsive to a wireless signal from said central computer or from any one individual EPAD of the plurality of EPADs.

15. The system of claim 14, wherein each individual EPAD further comprises at least one microphone connected to accept game associated information input by voice.

16. The system of claim 14, wherein each individual EPAD further comprises an expansion slot operable connected with said microprocessor and capable of accepting a memory expansion card.

17. The system of claim 14, wherein each individual EPAD contains a sound generator which includes a referee game whistle.

18. The system of claim 14, wherein each individual EPAD further comprises an antenna coupled to said transceiver to thereby receive and transmit wireless signals.

19. A system of soccer electronic personal assistant devices (EPADs), said system comprising:

a plurality of electronic personal assistant devices (EPADs) for game officials, each individual EPAD including a housing having a connector for securing the EPAD to an official's wrist or arm, a card pocket with one or more player penalty cards located therein, a microprocessor programmed to process game associated information, memory storage associated with said microprocessor, a display screen operably connected to visually display game associated information, a keypad enabling the game official to enter or retrieve game associated information, one or more sound generators and a transceiver capable of wirelessly communicating game associated information among the plurality or EPADs, wherein each individual EPAD of the plurality of EPADs is carried by one game official and has an individual electronic signature identifying the official carrying the EPAD, each individual EPAD of the plurality of EPADs being carried by one game official and containing an electronic signature identifying the official carrying the EPAD; and a plurality of electronic personal assistant devices (EPADs) for individual audience members, each individual audience EPAD including a housing, a microprocessor programmed to process game associated information, memory storage associated with said microprocessor for storing game associate information, a receiver capable of wirelessly receiving game associated information from the plurality of game official EPADs, a keypad enabling the individual audience member to retrieve stored game associated information and a display screen operably connected to visually display game associated information.

* * * * *